US007868823B2

(12) United States Patent
Haskell

(10) Patent No.: US 7,868,823 B2
(45) **Date of Patent: *Jan. 11, 2011**

(54) PHASED ARRAY ANTENNA SYSTEM WITH VARIABLE ELECTRICAL TILT

(75) Inventor: Philip Edward Haskell, Hampshire (GB)

(73) Assignee: Quintel Technology Limited (GB)

( * ) Notice: Subject to any disclaimer, the term of this patent is extended or adjusted under 35 U.S.C. 154(b) by 0 days.

This patent is subject to a terminal disclaimer.

(21) Appl. No.: 12/111,901

(22) Filed: Apr. 29, 2008

(65) Prior Publication Data

US 2008/0211716 A1 Sep. 4, 2008

Related U.S. Application Data

(63) Continuation of application No. 10/551,798, filed as application No. PCT/GB2004/001297 on Mar. 25, 2004, now Pat. No. 7,400,296.

(30) Foreign Application Priority Data

Apr. 2, 2003 (GB) ..... 0307558.7

(51) Int. Cl.
*H01Q 3/00* (2006.01)

(52) U.S. Cl. ..... 342/372

(58) Field of Classification Search ..... 342/368–372
See application file for complete search history.

(56) References Cited

U.S. PATENT DOCUMENTS 2,041,600 A 5/1936 Friis
2,239,775 A 4/1941 Bruce
2,245,660 A 6/1941 Feldman et al.
2,247,666 A 7/1941 Potter
2,961,620 A 11/1960 Sommers
3,277,481 A 10/1966 Robin et al.
3,522,558 A 8/1970 Stafford et al.
4,241,352 A 12/1980 Alspaugh et al.
4,249,181 A 2/1981 Lee
4,788,515 A 11/1988 Wong et al.

(Continued)

FOREIGN PATENT DOCUMENTS

AU 38746/93 7/1993

(Continued)

OTHER PUBLICATIONS

Strickland, "Microstrip Base Station Antennas for Cellular Communications", IEEE, pp. 166-171 (1991).

*Primary Examiner*—Thomas H Tarcza
*Assistant Examiner*—Nga X Nguyen

(57) ABSTRACT

A phased array antenna system with variable electrical tilt comprises an array of antenna elements etc. incorporating a divider dividing a radio frequency (RF) carrier signal into two signals between which a phase shifter introduces a variable phase shift. A phase to power converter converts the phase shifted signals into signals with powers dependent on the phase shift. Power splitters divide the converted signals into two sets of divided signals with total number equal to the number of antenna elements in the array. Power to phase converters etc. combine pairs of divided signals from different power splitters this provides vector sum and difference components with appropriate phase for supply to respective pairs of antenna elements etc. located equidistant from an array centre. Adjustment of the phase shift provided by phase shifter changes the angle of electrical tilt of the antenna array.

23 Claims, 11 Drawing Sheets

U.S. PATENT DOCUMENTS

| | | | | |
|---|---|---|---|---|
| 4,881,082 | A | 11/1989 | Graziano | |
| 4,905,012 | A | 2/1990 | Foti | |
| 5,281,974 | A | 1/1994 | Kuramoto et al. | |
| 5,929,804 | A | 7/1999 | Jones et al. | |
| 5,963,165 | A | 10/1999 | Das | |
| 7,400,296 | B2 * | 7/2008 | Haskell | 342/372 |

FOREIGN PATENT DOCUMENTS

| | | |
|---|---|---|
| AU | 664625 | 11/1995 |
| EP | 0 575 808 | 12/1993 |
| EP | 0 531 090 | 3/2000 |
| EP | 1026778 | 8/2000 |
| GB | 1 314 693 | 4/1973 |
| GB | 2034525 | 6/1980 |
| JP | 61-006901 | 1/1986 |
| JP | 61-172411 | 8/1986 |
| JP | 02-174302 | 7/1990 |
| JP | 04-320121 | 11/1992 |
| JP | 04-320122 | 11/1992 |
| JP | 05-37222 | 2/1993 |
| JP | 05-075340 | 3/1993 |
| JP | 05-121902 | 5/1993 |
| JP | 05-121915 | 5/1993 |
| JP | 140985 | 5/1994 |
| JP | 06-196927 | 7/1994 |
| JP | 06-260823 | 9/1994 |
| JP | 06-326501 | 11/1994 |
| JP | 09-148835 | 6/1997 |
| JP | 2001-211025 | 8/2001 |
| WO | WO 89/07837 | 8/1989 |
| WO | WO 92/16061 | 9/1992 |
| WO | WO 93/15569 | 8/1993 |
| WO | WO 95/10862 | 4/1995 |
| WO | WO 01/29926 | 4/2001 |
| WO | WO 03/036756 | 5/2003 |
| WO | WO 03/043127 | 5/2003 |

* cited by examiner

PHASED ARRAY ANTENNA SYSTEM WITH VARIABLE ELECTRICAL TILT

CROSS-REFERENCE TO RELATED APPLICATIONS

This application is a continuation of U.S. patent application Ser. No. 10/551,798, filed on Sep. 30, 2005, which is now U.S. Pat. No. 7,400,296, which was filed as application No. PCT/GB2004/001297 on Mar. 25, 2004. The aforementioned related patent application is herein incorporated by reference.

BACKGROUND OF THE INVENTION (1) Field of the Invention

The present invention relates to a phased array antenna system with variable electrical tilt. The antenna system is suitable for use in many telecommunications systems, but finds particular application in cellular mobile radio networks, commonly referred to as mobile telephone networks. More specifically, but without limitation, the antenna system of the invention may be used with second generation (2G) mobile telephone networks such as the GSM system, and third generation (3G) mobile telephone networks such as the Universal Mobile Telephone System (UMTS).

(2) Description of the Art

Operators of cellular mobile radio networks generally employ their own base-stations, each of which has at least one antenna. In a cellular mobile radio network, the antennas are a primary factor in defining a coverage area in which communication to the base station can take place. The coverage area is generally divided into a number of overlapping cells, each associated with a respective antenna and base station.

Each cell contains a base station for radio communication with all of the mobile radios in that cell. Base stations are interconnected by other means of communication, usually fixed land-lines arranged in a grid or meshed structure, allowing mobile radios throughout the cell coverage area to communicate with each other as well as with the public telephone network outside the cellular mobile radio network.

Cellular mobile radio networks which use phased array antennas are known: such an antenna comprises an array (usually eight or more) individual antenna elements such as dipoles or patches. The antenna has a radiation pattern incorporating a main lobe and sidelobes. The centre of the main lobe is the antenna's direction of maximum sensitivity in reception mode and the direction of its main output radiation beam in transmission mode. It is a well known property of a phased array antenna that if signals received by antenna elements are delayed by a delay which varies with element distance from an edge of the array, then the antenna main radiation beam is steered towards the direction of increasing delay. The angle between main radiation beam centres corresponding to zero and non-zero variation in delay, i.e. the angle of tilt, depends on the rate of change of delay with distance across the array.

Delay may be implemented equivalently by changing signal phase, hence the expression phased array. The main beam of the antenna pattern can therefore be altered by adjusting the phase relationship between signals fed to antenna elements. This allows the beam to be steered to modify the coverage area of the antenna.

Operators of phased array antennas in cellular mobile radio networks have a requirement to adjust their antennas' vertical radiation pattern, i.e. the pattern's cross-section in the vertical plane. This is necessary to alter the vertical angle of the antenna's main beam, also known as the "tilt", in order to adjust the coverage area of the antenna. Such adjustment may be required, for example, to compensate for change in cellular network structure or number of base stations or antennas. Adjustment of antenna angle of tilt is known both mechanically and electrically, either individually or in combination.

Antenna angle of tilt may be adjusted mechanically by moving antenna elements or their housing (radome): it is referred to as adjusting the angle of "mechanical tilt". As described earlier, antenna angle of tilt may be adjusted electrically by changing time delay or phase of signals fed to or received from each antenna array element (or group of elements) without physical movement: this is referred to as adjusting the angle of "electrical tilt".

When used in a cellular mobile radio network, a phased array antenna's vertical radiation pattern (VRP) has a number of significant requirements:

1. high boresight gain;
2. a first upper side lobe level sufficiently low to avoid interference to mobiles using a base station in a different network;
3. a first lower side lobe level sufficiently high to allow communications in the immediate vicinity of the antenna.

The requirements are mutually conflicting, for example, increasing the boresight gain will increase the level of the side lobes. A first upper side lobe level, relative to the boresight level, of −18 dB has been found to provide a convenient compromise in overall system performance.

The effect of adjusting either the angle of mechanical tilt or the angle of electrical tilt is to reposition the boresight so that, for an array lying in a vertical plane, it points either above or below the horizontal plane, and hence changes the coverage area of the antenna. It is desirable to be able to vary both the mechanical tilt and the electrical tilt of a cellular radio base station's antenna: this allows maximum flexibility in optimisation of cell coverage, since these forms of tilt have different effects on antenna ground coverage and also on other antennas in the station's immediate vicinity. Also, operational efficiency is improved if the angle of electrical tilt can be adjusted remotely from the antenna assembly. Whereas an antenna's angle of mechanical tilt may be adjusted by re-positioning its radome, changing its angle of electrical tilt requires additional electronic circuitry which increases antenna cost and complexity. Furthermore, if a single antenna is shared between a number of operators it is preferable to provide a different angle of electrical tilt for each operator.

The need for an individual angle of electrical tilt from a shared antenna has hitherto resulted in compromises in the performance of the antenna. The boresight gain will decrease in proportion to the cosine of the angle of tilt due to a reduction in the effective aperture of the antenna (this is unavoidable and happens in all antenna designs). Further reductions in boresight gain may result as a consequence of the method used to change the angle of tilt.

R. C. Johnson, Antenna Engineers Handbook, 3rd Ed 1993, McGraw Hill, ISBN 0-07-032381—X, Ch 20, FIG. 20-2 discloses a known method for locally or remotely adjusting a phased array antenna's angle of electrical tilt. In this method a radio frequency (RF) transmitter carrier signal is fed to the antenna and distributed to the antenna's radiating elements. Each antenna element has a respective phase shifter associated with it so that signal phase can be adjusted as a function of distance across the antenna to vary the antenna's angle of electrical tilt. The distribution of power to antenna elements when the antenna is not tilted is proportioned so as to set the side lobe level and boresight gain. Optimum control of the angle of tilt is obtained when the phase front is controlled for all angles of tilt so that the side lobe level is not increased over the tilt range. The angle of electrical tilt can be adjusted remotely, if required, by using a servo-mechanism to control the phase shifters.

This prior art method antenna has a number of disadvantages. A phase shifter is required for every antenna element. The cost of the antenna is high due to the number of phase shifters required. Cost reduction by applying delay devices to groups of antenna elements instead of individual elements increases the side lobe level. Mechanical coupling of delay devices is used to adjust delays, but it is difficult to do this correctly; moreover, mechanical links and gears are required resulting in a non-optimum distribution of delays. The upper side lobe level increases when the antenna is tilted downwards thus causing a potential source of interference to mobiles using other base stations. If the antenna is shared by a number of operators, the operators have a common angle of electrical tilt instead of different angles. Finally, if the antenna is used in a communications system having (as is common) up-link and down-link at different frequencies (frequency division duplex system), the angle of electrical tilt in transmit is different to that in receive.

International Patent Application Nos. PCT/GB2002/004166 and PCT/GB2002/004930 describe locally or remotely adjusting an antenna's angle of electrical tilt by means of a difference in phase between a pair of signal feeds connected to the antenna.

SUMMARY OF THE INVENTION

It is an object of the present invention to provide an alternative form of phased array antenna system.

The present invention provides a phased array antenna system with variable electrical tilt and including an array of antenna elements characterised in that it incorporates:

a) a divider for dividing a radio frequency (RF) carrier signal into first and second signals, b) a variable phase shifter for introducing a variable relative phase shift between the first and second signals, c) a phase to power converter for converting the relatively phase shifted first and second signals into signals whose powers are a function of the relative phase shift, d) first and second power splitters for dividing the converted signals into at least two sets of divided signals, the total number of divided signals in the sets being at least equal to the number of antenna elements in the array, e) power to phase converters for combining pairs of divided signals from different power splitters to provide vector sum and difference components with appropriate phase for supply to respective pairs of antenna elements located at like distances with respect to an array centre.

In its various embodiments the invention can be configured to provide a variety of advantages, that is to say it:

a) requires only one phase shifter or time delay device per operator to set the angle of electrical tilt;

b) can provide a good level of side lobe suppression;

c) has a controlled upper side lobe level when tilted downwards;

d) can provide different angles of tilt for different operators when used as a shared antenna;

e) can provide either local, or remote, control of the angle of electrical tilt;

f) can be implemented with lower cost than contemporary antennas having a similar level of performance; and g) can have an angle of electrical tilt at transmit frequencies that is either the same as or different to the angle of electrical tilt at receive frequencies, at the operator's option.

The system of the invention may have an odd number of antenna elements comprising a central antenna element located centrally of each like distant pair of antenna elements. It may include a third power splitter connected between the phase to power converter and one of the first and second power splitters and arranged to divert to the central element a proportion of the power from the phase to power converter.

The phase to power and power to phase converters may be combinations of phase shifters and 90 or 180 degree hybrid couplers. The divider, phase shifter, phase to power and power to phase converters and power splitters may be co-located with the array of antenna elements as an antenna assembly, and the assembly may have a single RF input power feed from a remote source.

The divider and phase shifter may alternatively be located remotely from the phase to power and power to phase converters, the power splitters and the array of antenna elements which are co-located as an antenna assembly, and the assembly may have dual RF input power feeds from a remote source. They may be co-located with the remote source for use by an operator in varying angle of electrical tilt.

The system may include duplexers to combine signals passing from or divide signals passing to different operators which share the antenna system. The power splitters may be arranged to provide for the antenna elements to receive drive voltages which fall from a maximum centrally of the antenna array to a minimum at array ends.

One power splitter may be arranged to provide a set of voltages which rise from a minimum to a maximum associated with the antenna array centre and its ends respectively, as appropriate to establish a progressive phase front across the antenna array, the phase front being substantially linear as an angle of tilt is increased in a working range of tilt, as required for reasonable boresight gain and side lobe suppression.

In an alternative aspect, the present invention provides a method of providing variable electrical tilt in a phased array antenna system including an array of antenna elements characterised in that the method incorporates the steps of:

a) dividing a radio frequency (RF) carrier signal into first and second signals, b) introducing a variable relative phase shift between the first and second signals, c) converting the relatively phase shifted first and second signals into signals whose powers are a function of the relative phase shift, d) using power splitters to divide the converted signals into at least two sets of divided signals, the total number of divided signals in the sets being at least equal to the number of antenna elements in the array, e) combining pairs of divided signals from different power splitters to provide vector sum and difference components with appropriate phase and supplying the components to respective pairs of antenna elements located at like distances with respect to an array centre.

The antenna array may have an odd number of antenna elements (E0 to E7L) comprising a central antenna element (E0) located centrally of each pair of like distant antenna elements The phased array antenna system may include a third power splitter connected to receive one of the signals whose power is a function of the relative phase shift and the method includes using such splitter to divert to the central antenna element a proportion of the power in such signal.

Conversion of the relatively phase shifted first and second signals and combining of pairs of divided signals may be implemented respectively using phase to power and power to phase converters incorporating 90 or 180 degree hybrid couplers.

Steps a) to e) of the method may implemented using components co-located with the array of antenna elements to form an antenna assembly with input from a single RF input power feed from a remote source. Alternatively, steps a) and b) may be implemented using components located remotely of the array of antenna elements, with steps c) to e) being implemented using components co-located with the array and forming therewith an antenna assembly having dual RF input power feeds from a remote source. Step b) may include varying the relative phase shift to vary the angle of electrical tilt.

The method may include combining signals passing from or dividing signals passing to different operators which share the antenna system. It may include providing for the antenna elements to receive drive voltages which fall from a maximum centrally of the antenna array to a minimum at array ends.

Step d) may include providing for one set of divided signals to rise from a minimum to a maximum associated with the antenna array centre and its ends respectively, as appropriate to establish a progressive phase front across the antenna array, the phase front being substantially linear as an angle of tilt is increased in a working range of tilt, as required for reasonable boresight gain and side lobe suppression.

DESCRIPTION OF THE FIGURES

In order that the invention might be more fully understood, embodiments thereof will now be described, by way of example only, with reference to the accompanying drawings, in which.

DESCRIPTION OF A PREFERRED EMBODIMENT

Figure 1:
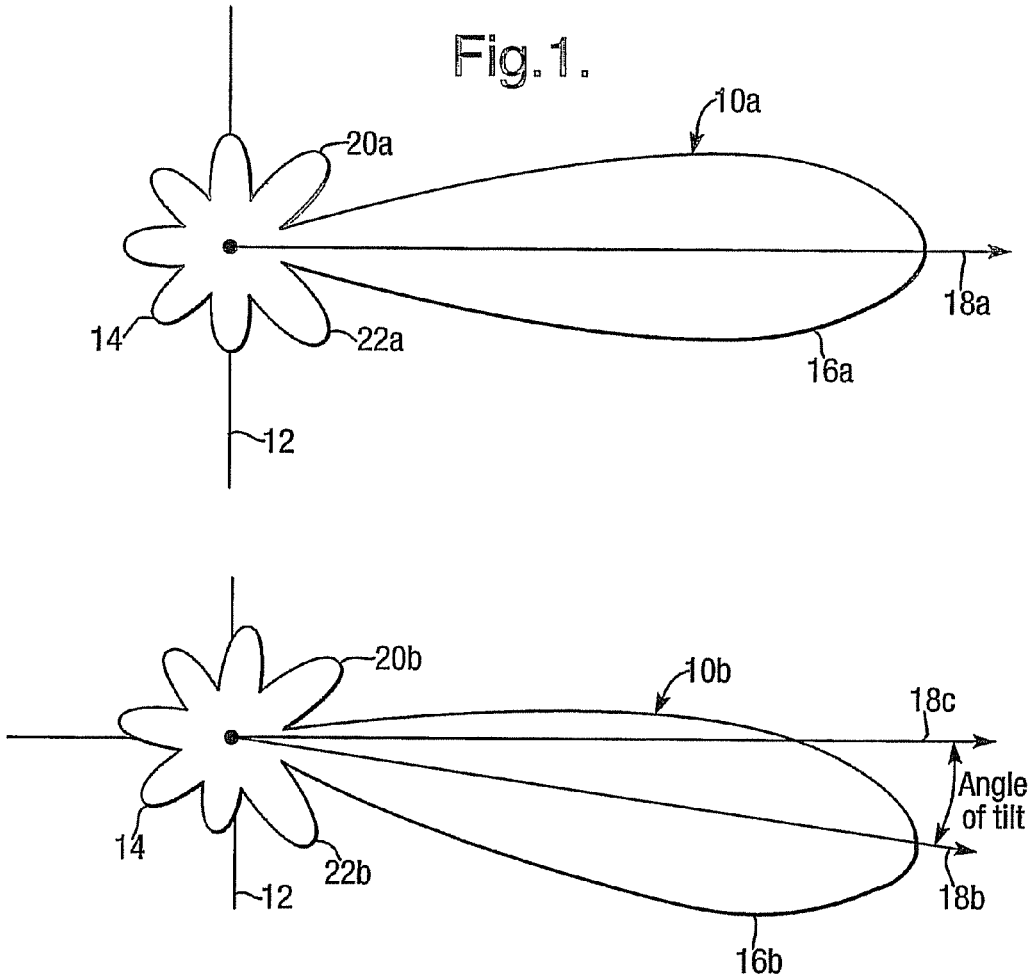
FIG. 1 shows a phased array antenna's vertical radiation pattern (VRP) with zero and non-zero angles of electrical tilt.

Referring to FIG. 1, there are shown vertical radiation patterns (VRP) 10*a* and 10*b* of an antenna 12 which is a phased array of individual antenna elements (not shown). The antenna 12 is planar, has a centre 14 and extends perpendicular to the plane of the drawing. The VRPs 10*a* and 10*b* correspond respectively to zero and non-zero variation in delay or phase of antenna element signals with array element distance across the antenna 12 from an array edge. They have respective main lobes 16*a*, 16*b* with centre lines or "boresights" 18*a*, 18*b*, first upper sidelobes 20*a*, 20*b* and first lower sidelobes 22*a*, 22*b*; 18*c* indicates the boresight direction for zero variation in delay for comparison with the non-zero equivalent 18*b*. When referred to without the suffix a or b, e.g. sidelobe 20, either of the relevant pair of elements is being referred to without distinction. The VRP 10*b* is tilted (downwards as illustrated) relative to VRP 10*a*, i.e. there is an angle—the angle of tilt—between main beam centre lines 18*b* and 18*c* which has a magnitude dependent on the rate at which delay varies with distance across the antenna 12.

The VRP has to satisfy a number of criteria: a) high boresight gain; b) the first upper side lobe 20 should be at a level low enough to avoid causing interference to mobiles using another base station; and c) the first lower side lobe 22 should be at a level sufficient for communications to be possible in the antenna 12's immediately vicinity. These requirements are mutually conflicting, for example, maximising boresight gain increases side lobes 20, 22. Relative to a boresight level (length of main beam 16), a first upper side lobe level of −18 dB has been found to provide a convenient compromise in overall system performance. Boresight gain decreases in proportion to the cosine of the angle of tilt due to reduction in the antenna's effective aperture. Further reductions in boresight gain may result depending on how the angle of tilt is changed.

The effect of adjusting either the angle of mechanical tilt or the angle of electrical tilt is to reposition the boresight so that it points either above or below the horizontal plane, and hence adjusts the coverage area of the antenna. For maximum flexibility of use, a cellular radio base station preferably has available both mechanical tilt and electrical tilt since each has a different effect on ground coverage and also on other antennas in the immediate vicinity. It is also convenient if an antenna's electrical tilt can be adjusted remotely from the antenna. Furthermore, if a single antenna is shared between a number of operators, it is preferable to provide a different angle of electrical tilt for each operator, although this compromises antenna performance in the prior art.

Figure 2:
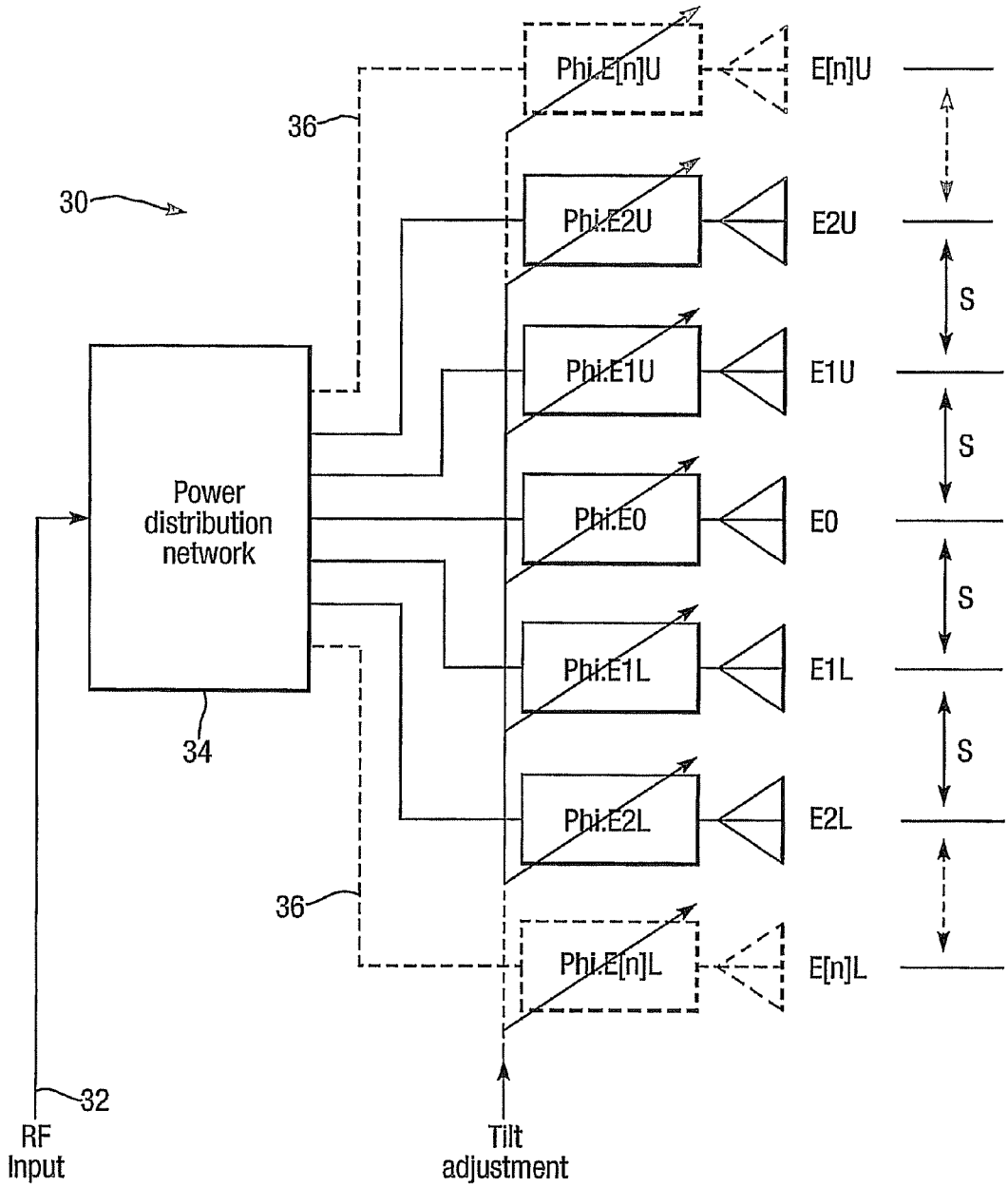
Fig.2. (Prior art)
FIG. 2 illustrates a prior art phased array antenna having an adjustable angle of electrical tilt.

Referring now to FIG. 2, a prior art phased array antenna system 30 is shown in which the angle of electrical tilt is adjustable. The system 30 incorporates an input 32 for a radio frequency (RF) transmitter carrier signal, the input being connected to a power distribution network 34. The network 34 is connected via phase shifters Phi.E0, Phi.E1L to Phi.E[n]L and Phi.E1U to Phi.E[n]U to respective radiating antenna elements E0, E1L to E[n]L and E1U to E[n]U respectively of the phased array antenna system 30: here suffixes U and L indicate upper and lower respectively, n is an arbitrary positive integer greater than unity which defines phased array size, and dotted lines such as 36 indicating the relevant element may be replicated or removed as required for any desired array size.

The phased array antenna system 30 operates as follows. An RF transmitter carrier signal is fed to the power distribution network 34 via the input 32: the network 34 divides this signal (not necessarily equally) between the phase shifters Phi.E0, Phi.E1L to Phi.E[n]L and Phi.E1U to Phi.E[n]U, which phase shift their respective divided signals and pass them on with phase shifts to associated antenna elements E0, E1L to E[n]L, E1U to E[n]U respectively. The phase shifts are chosen to select an appropriate angle of electrical tilt. The distribution of power between the antenna elements E0 etc. when the angle of tilt is zero is chosen to set the side lobe level and boresight gain appropriately. Optimum control of the angle of electrical tilt is obtained when the phase front across the array of elements E0 etc. is controlled for all angles of tilt so that the side lobe level is not increased significantly over the tilt range. The angle of electrical tilt can be adjusted remotely, if required, by using a servo-mechanism to control the phase shifters Phi.E0, Phi.E1L to Phi.E[n]L and Phi.E1U to Phi.E[n]U, which may be mechanically actuated.

The phased array antenna system 30 has a number of disadvantages as follows:

a) a phase shifter is required for each antenna element, or (less advantageously) per group of elements;
b) the cost of the antenna is high due to the number of phase shifters required;
c) cost reduction by applying phase shifters to respective groups of elements instead of individual antenna elements increases the side lobe level;
d) mechanical coupling of phase shifters to set delays correctly is difficult and mechanical links and gears are used which result in a non-optimum delay scheme;
e) the upper side lobe level increases when the antenna is tilted downwards causing a potential source of interference to mobiles using other base stations;
f) if an antenna is shared by different operators, all must use the same angle of electrical tilt; and
g) in a system with up-link and down-link at different frequencies (frequency division duplex system), the angle of electrical tilt in transmission mode is different from that in reception mode.

Figure 3:
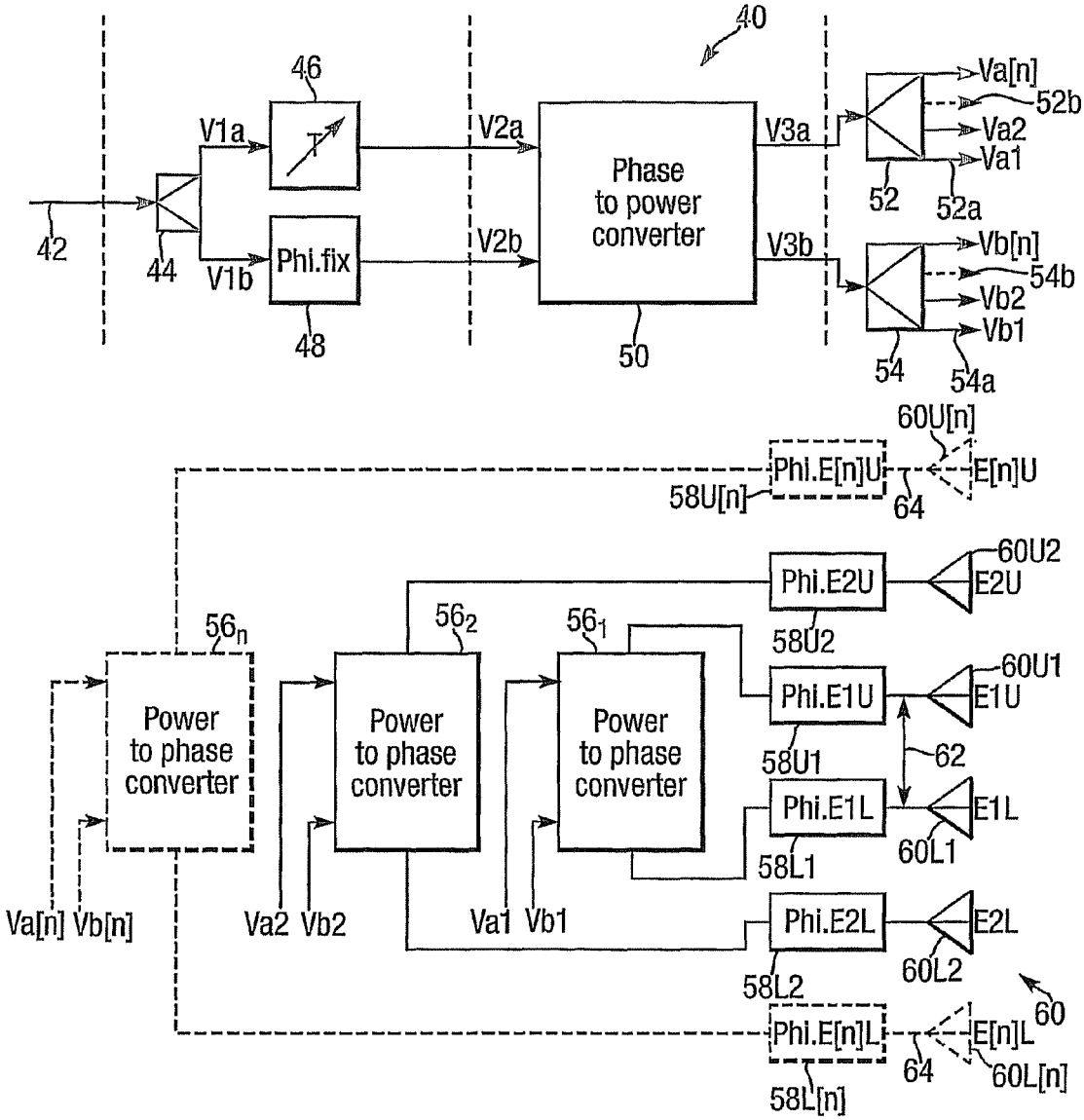
FIG. 3 is a block diagram of a phased array antenna system of the invention in a single feeder application.

Referring now to FIG. 3, a phased array antenna system 40 of the invention is shown which has an adjustable angle of electrical tilt. The system 40 incorporates an input 42 for an RF transmitter carrier signal: the input 42 is connected as input to a power splitter 44 providing two output signals V1*a*, V1*b* which are input signals to a variable phase shifter 46 and a fixed phase shifter 48 respectively. The phase shifters 46 and 48 may equivalently be considered as time delays. They provide respective output signals V2*a* and V2*b* to a phase to power converter 50, which in turn provides output signals V3*a* and V3*b* to two power splitters 52 and 54 respectively. The phase to power converter 50 will be described in more detail later. The power splitters 52 and 54 have n outputs such as 52*a* and 54*a* respectively: here n is a positive integer equal to 2 or more, and dotted arrow outputs 52*b* and 54*b* indicate the output in each case may be replicated as required for any desired phased array size.

The power splitter outputs such as 52*a* and 54*a* provide output signals Va1 to Va[n] and Vb1 to Vb[n] respectively which are grouped in pairs Vai/Vbi (i=1 to n), one signal from each splitter in each pair; each pair of signals Vai/Vbi is connected (not shown) to a respective power to phase converter $\mathbf{56}_1$. A first power to phase converter $\mathbf{56}_1$ receives inputs Va1/Nb1 and provides drive signals via respective fixed phase shifters 58U1 and 58L1 to a first pair of equispaced phased array antenna elements 60U1 and 60L1 which are the innermost elements of an array 60. Pairs of adjacent antenna elements such as 60U1 and 60L1 are spaced apart by a centre spacing 62. A second power to phase converter 562 receives input signals Va2 and Vb2: it provides drive signals via respective fixed phase shifters 58U2 and 58L2 to a second pair of phased array antenna elements 60U2 and 60L2, which are next to respective innermost elements 60U1 and 60L1. Likewise, an nth power to phase converter $\mathbf{56}_n$ receives inputs Va[n]/Vb[n]: it provides drive signals via respective fixed phase shifters 58Un and 58Ln to an nth pair of phased array antenna elements 60*n* and 60Ln. This nth pair have centres 64 distant (n−1) centre spacings 62 from respective innermost elements 60U1 and 60L1. Here as before n is an arbitrary positive integer equal to or greater than 2 but equal to the value of n for the power splitters 52 and 54, and phased array size is 2n antenna elements. The power to phase converter $\mathbf{56}_n$ and outermost antenna elements 60Un and 60Ln are shown dotted to indicate they may be replicated as required for any desired phased array size.

The phased array antenna system 40 operates as follows. An RF transmitter carrier signal is fed (single feeder) via the input 42 to the power splitter 44 where it is divided into signals V1*a* and V1*b* of equal power. The signals V1*a* and V1*b* are fed to the variable and fixed phase shifters 46 and 48 respectively. The variable phase shifter 46 applies an operator-selectable phase shift or time delay, and the degree of phase shift applied here controls the angle of electrical tilt of the phased array of antenna elements 58U1 etc. The fixed phase shifter 48 applies a fixed phase shift which for convenience is arranged to be half the maximum phase shift $\phi_M$ applicable by the variable phase shifter 46. This allows V1*a* to be variable in phase in the range $-\phi_M/2$ to $+\phi_M/2$ relative to V1*b*; and these signals after phase shift become V2*a* and V2*b* as has been said after output from the phase shifters 46 and 48.

The phase to power converter 50 combines its input signals V2*a* and V2*b* and generates from them two output signals V3*a* and V3*b* having powers relative to one another which depend on the relative phase difference between its inputs. The power splitters 52 and 54 divide signals V3*a* and V3*b* into n output signals Va1 to Va[n] and Vb1 to Vb[n] respectively, where the power of each signal in each set Va1 etc or Vb1 etc is not necessarily equal to the powers of the other signals in its set. Splitter 52 is an 'amplitude taper splitter' controlling antenna element power and splitter 54 is a 'tilt splitter' controlling tilt.

The variation of signal powers across the sets Va1 etc and Vb1 etc is different for different numbers of antenna elements 60U1 etc in the array 60, and examples will be described later for arrays of fixed sizes.

The output signals Va1/Vb1 to Va[n] and Vb1 to Vb[n] are grouped in pairs from different splitters but with like-numbered suffixes, i.e. pairs Va1/Vb1, Va2/Vb2 etc. The pairs Va1/Vb1 etc. are fed to respective power to phase converters $\mathbf{56}_1$ etc., which convert each pair into two antenna element drive signals with a relative phase difference between them. Each drive signal passes via a respective fixed phase shifter 58U1 etc. to a respective antenna element 60U1 etc. The fixed phase shifters 58U1 etc. impose fixed phase shifts which between different antenna elements 60U1 etc. vary linearly according to element geometrical position across the array 60: this is to set a zero reference direction (18*a* or 18*b* in FIG. 1) for the array 60 boresight when the phase difference between the signals V1*a* and V1*b* imposed by the variable phase shifter 46 is zero. The fixed phase shifters 58U1 etc. are not essential, but they are preferred because they can be used to a) proportion correctly the phase shift introduced by the tilt process, b) optimise suppression of the side lobes over the tilt range, and c) introduce an optional fixed, angle of electrical tilt.

It can be shown (as described later) that the angle of electrical tilt of the array 60 is variable simply by using one variable phase shifter, the variable phase shifter 46. This compares with the prior art requirement to have multiple variable phase shifters, one for every antenna element. When the phase difference introduced by the variable phase shifter 46 is positive the antenna tilts in one direction, and when that phase difference is negative the antenna tilts in the opposite direction.

If there are a number of users, each user may have a respective phased array antenna system 40. Alternatively, if it is required that the users employ a common antenna 60, then each user has a respective set of elements 42 to 58U/58L in FIG. 3, and a combining network is required to combine signals from the resulting plurality of sets of phase shifters 58U etc. for feeding to the antenna array 60. Published International Patent Application No. WO 02/082581 A2 describes such a network.

Figure 4:
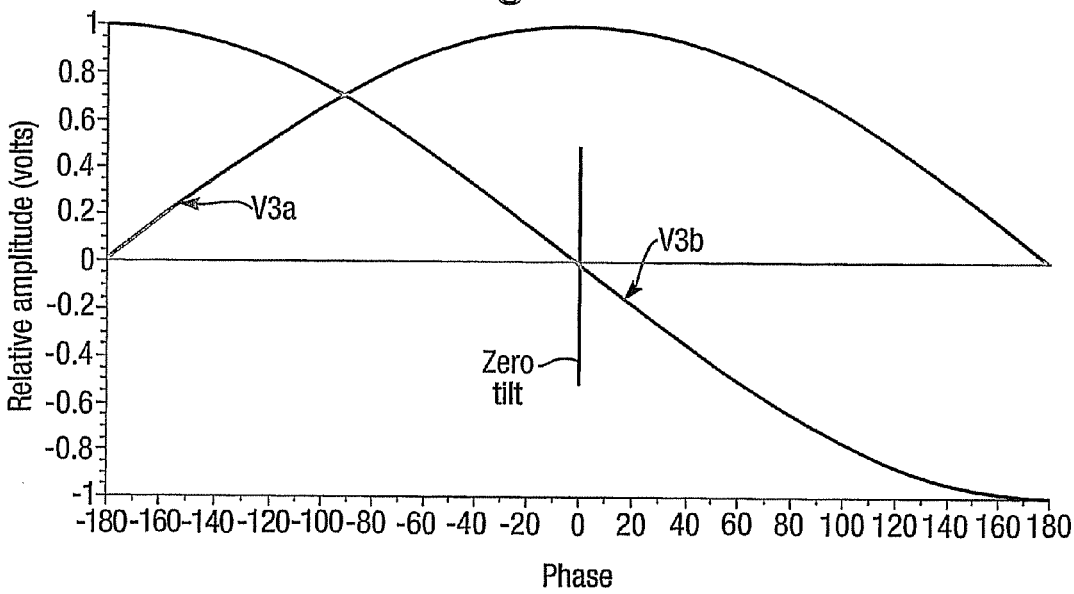
FIG. 4 shows relationships between voltage outputs and input phase difference in a phase to power converter used in the FIG. 3 system.

Referring now to FIG. 4, this drawing shows the voltages of the phase to power converter output signals V3*a* and V3*b* plotted as a function of difference in phase between V2*a* and V2*b* introduced by the phase shifter 46. Here V3*a* and V3*b* are normalised to a maximum of 1 volt. The phase angles of the signals V3*a* and V3*b* remain equal and unchanged as the power of one reduces and that of the other increases as a consequence of changing the relative phase difference between V2*a* and V2*b* introduced by variable phase shifter 46. However, a negative voltage for V3*b* represents a 180 degree phase shift of that signal relative to V3*a*.

Figure 5:
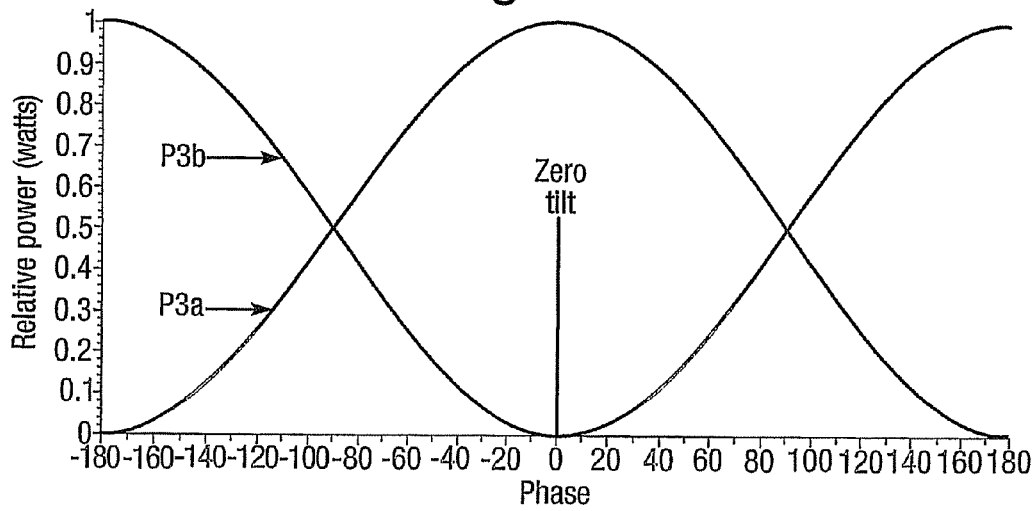
FIG. 5 is equivalent to FIG. 4 with power is substituted for voltage.

FIG. 5 is equivalent to FIG. 4 except that it is a plot of power, normalised to 1 watt, against phase difference V2*a*/V2*b* for signals Va3 and Vb3, their powers being denoted by P3*a* and P3*b* respectively. It shows that when the antenna is not tilted, i.e. when phase=0, P3*a* is a maximum and P3*b*=0: therefore all signal power is fed to the first splitter 52 when phase=0 and the second splitter 54 receives zero power. Hence, the distribution of voltages (Va1, Va2, . . . Va[n]) when the antenna is not tilted determines the boresight gain and the level of the side lobes for zero tilt.

Figure 6:
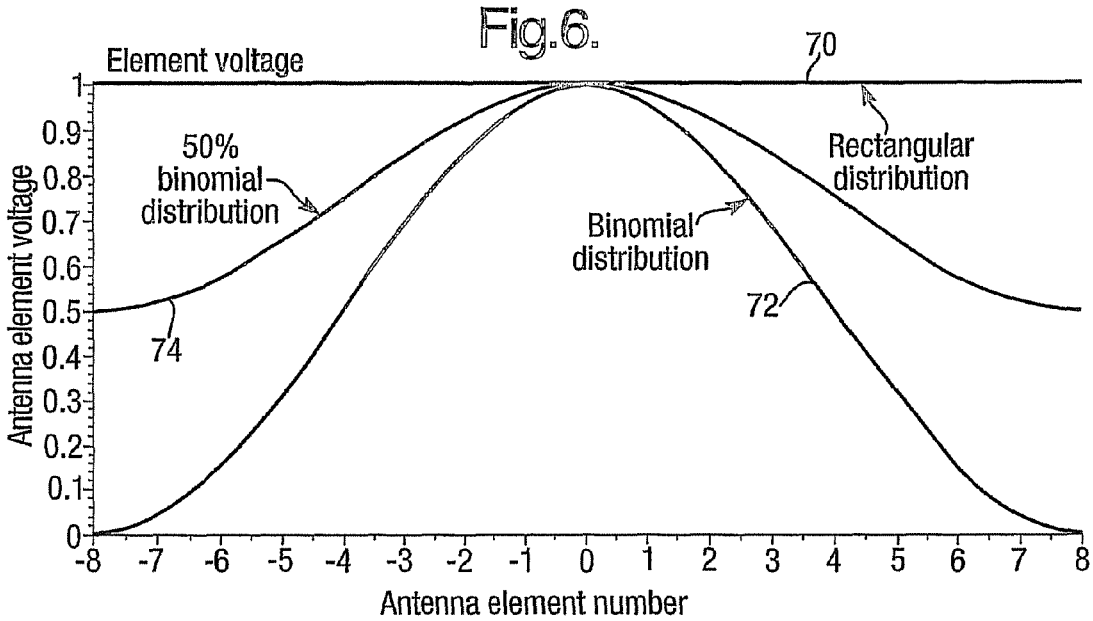
FIG. 6 gives examples of possible voltage distributions at outputs of a voltage splitter used in the FIG. 3 system.

The effects of different voltage distributions across the elements of a phased array antenna are well known. FIG. 6 illustrates three different voltage distributions for a phased array antenna having seventeen antenna elements, voltage being plotted against antenna element number: here the antenna elements are considered to be arranged in a vertical plane, a central antenna element being numbered 0. Positive and negative antenna element numbers are assigned according to whether the antenna element in each case is above or below the central antenna element 0, and antenna element number magnitude in each case is proportional to the separation between the relevant element and the central element. Antenna element voltage is normalised by division by the central antenna element voltage, so the central antenna element 0 has voltage 1.0 relative to other antenna elements.

If a phased array antenna is primarily required to have maximum boresight gain then a rectangular distribution of antenna element voltages is used, i.e. the antenna elements all have the same drive voltage as indicated by a linear horizontal plot 70. If maximum suppression of side lobe level is required, a binomial distribution 72 of antenna element voltages is used. Alternatively, a distribution 74 may be used which is part rectangular and part binomial. The distribution 74 is half the sum of the distributions 70 and 72. In distribution 72, outermost elements 8 and −8 receive zero power and can be omitted from the phased array.

It has been found to be advantageous in this invention for the level of the side lobes to be optimised at the maximum angle of electrical tilt. Side lobe levels will then be less than the level at the maximum angle of tilt for all tilt angles below the maximum; Referring to FIG. 3 once more, to tilt the phased array antenna 60 electrically the power fed to the second splitter 54 is increased from zero; the ith upper and lower antenna elements 60Ui and 60Li (i=1 to n) then receive drive signals having phase and amplitude determined by vectorially combining signals Va[i] and Vb[i]. The phase ϕu[i] of the signal fed to the ith upper element 60U[i] is given by:

$$\phi u[i] = \tan^{-1}\left(\frac{Vb[i]}{Va[i]}\right) \tag{1}$$

The phase shift ϕ[i] of the signal fed to the ith lower element 60U[i] is given by:

$$\phi l[i] = -\tan^{-1}\left(\frac{Vb[i]}{Va[i]}\right) \tag{2}$$

Equations (1) and (2) show that the phase of the drive signal applied to the ith upper antenna element 60U[i] is in the opposite direction to that applied to the ith lower antenna element 60L[i]. Now the voltages output from the second splitter 54 are chosen to increase from Vb1 to Vb[n], i.e. Vb[n]> . . . Vb[i]> . . . Vb2>Vb1: consequently, from Equations (1) and (2) a progressive phase front is established across the antenna 60 causing it to have a non-zero angle of electrical tilt. Furthermore, the phase front remains substantially linear as the angle of tilt is increased, thus preserving boresight gain and side lobe suppression. It can be seen from Equations (1) and (2) that the tilt sensitivity is determined by the power delivered by the second splitter 54. When implemented in this way the phased array antenna system 40 has a tilt sensitivity that is typically 1 degree of electrical tilt per 10 degrees of shift in phase.

The antenna system 40 may be implemented as a single feeder system or a dual feeder system (per operator in each case). In a single feeder system, a single signal feed 42 supplies a signal Vin to the antenna array 60 which may be mounted on a mast, and items 44 to 64 in FIG. 3 are mounted with the antenna array. This has the advantage that only one signal feed is needed to pass to the antenna system from a remote user, but against that a remote operator cannot adjust the angle of electrical tilt without access to the antenna system. Also, operators sharing a single antenna would all have the same angle of electrical tilt.

In a dual feeder system, two signals V2*a* and V2*b* are fed to an antenna array: items 42 to 48 (tilt control components) in FIG. 3 may be located with a user remotely from the antenna array 60, and items 50 to 64 are located with the antenna array. The user may now have direct access to the phase shifter 46 to adjust the angle of electrical tilt. It is also convenient to reduce tilt sensitivity to reduce the effects of phase differences between feeders and hence a difference between the angle of electrical tilt required by the operator and that at the antenna. With a respective set of tilt control components 42 to 48 located with each operator, and at an input side of a frequency selective combiner located at an operator's base station, it is possible to implement a shared antenna system with an individual angle of tilt for each operator.

To reduce the effects of variations in amplitude and phase between two feeders in a dual feeder system of the invention, tilt sensitivity may be decreased by reducing the power from the second splitter 54 used for electrical tilting. Tilting power from the second splitter 54 can be reduced by (a) feeding some of the power from splitter 54 to an additional antenna element whose phase shift is constant and positioned in the centre of the antenna array, or by (b) diverting some of this power into a termination, or (c) a combination of (a) and (b).

In order to avoid an undue reduction in the maximum value of antenna boresight gain it is preferable to divert some of the second splitter power into an additional central antenna element. When one half of the total second splitter power is fed to a central antenna element the tilt sensitivity is typically 20 degrees of phase shift per 1 degree of electrical tilt. As the tilt passes through zero the phase shift on the central antenna element changes by 180 degrees. This has the effect of introducing asymmetry between the levels of the upper and lower side lobes, unlike FIG. 1 where these lobes are symmetrical. In particular, this asymmetry suppresses the upper side lobe (corresponding to 20*a*) to further reduce the possibility of interference to mobile telephones using other base stations.

The embodiment 40 of the invention provides a number of advantages:

1. tilt is implemented with a single variable time delay device or phase shifter per user instead of per antenna element;
2. phase and amplitude tapers remain substantially constant over a range of tilt (4 degrees to 6 degrees, depending on frequency); here 'taper' is amplitude or phase profile across antenna elements.
3. side lobe suppression remains effective throughout the tilt range and can be controlled to less than 18 dB below the boresight level;
4. tilt sensitivity can be set to an optimum;
5. individual tilt angles are available for sharing of an antenna by multiple users;
6. the angle of tilt in transmit mode can be either the same as or different to from the angle of tilt in receive mode despite these modes having different frequencies, as will be described later; and
7. asymmetrical side lobe levels are obtainable to reduce the potential for interference with mobiles using other base stations.

Figure 7:
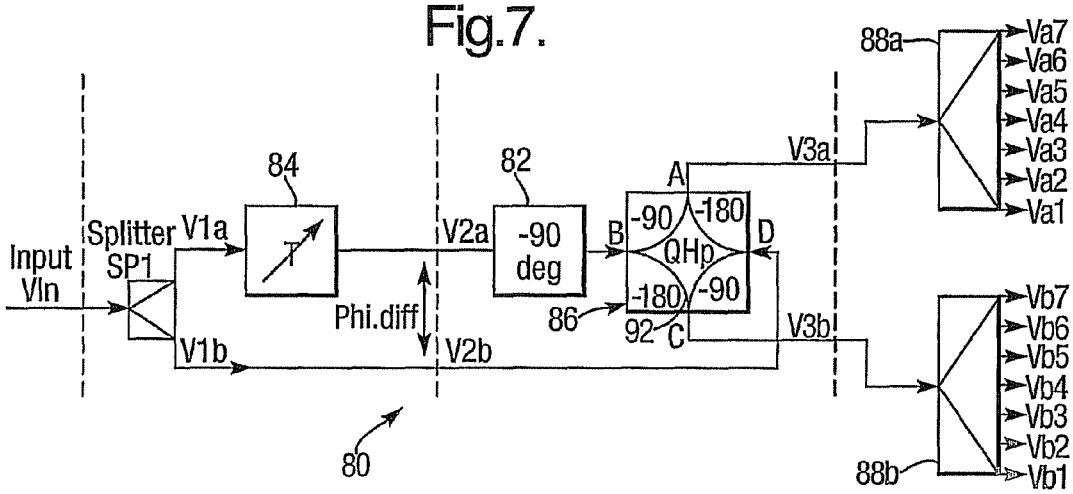
FIG. 7 is a block diagram of a part of a further phased array antenna system of the invention, and illustrates phase shifting, phase to power conversion and power division.

Referring now to FIG. 7, there is shown a circuit 80 for phase to power conversion and voltage splitting similar to the upper portion of FIG. 3. Only points of difference will be described. The differences as compared to FIG. 3 are that a fixed phase shifter 82 is connected series (instead of in parallel) with a variable phase shifter 84, an example of a phase to power conversion is given, and two splitters 88*a* and 88*b* each divide into seven outputs Va1/Vb1 etc. Signals pass from the fixed and variable phase shifters 82 and 84 to a quadrature hybrid directional coupler 86 ("quadrature hybrid") having four terminals A, B, C and D. Input-output paths between pairs of terminals A to D are indicated by curved lines such as 92. Phase to power conversion is obtained from the combination of the fixed phase shifter 82 and coupler 86. As indicated by markings −90 and −180, the quadrature hybrid 86 phase shifts its input signals by −90 or −180 depending upon where such signals are input and output: signal V2*a* from fixed phase shifter 86 is input to terminal B and output at terminals A and C to splitters 88*a* and 88*b* with phase shifts −90 degrees and −180 degrees respectively. Similarly, signal V2*b* from variable phase shifter 84 is input to terminal D and output at terminals A and C to splitters 88*a* and 88*b* with phase shifts −180 degrees and −90 degrees respectively. The splitters 88*a* and 88*b* provide power division broadly speaking as described earlier.

In FIG. 7 as has been said phase-to-power, conversion is shown implemented with quadrature hybrids also known as 90 degree hybrids, which can provide power-to-phase conversion also. Moreover, both phase-to-power and power-to-phase conversion can also be implemented with 180 degree hybrids, also known as sum and difference hybrids, when associated with appropriate fixed phase shifts to provide the required overall function.

Figure 8:
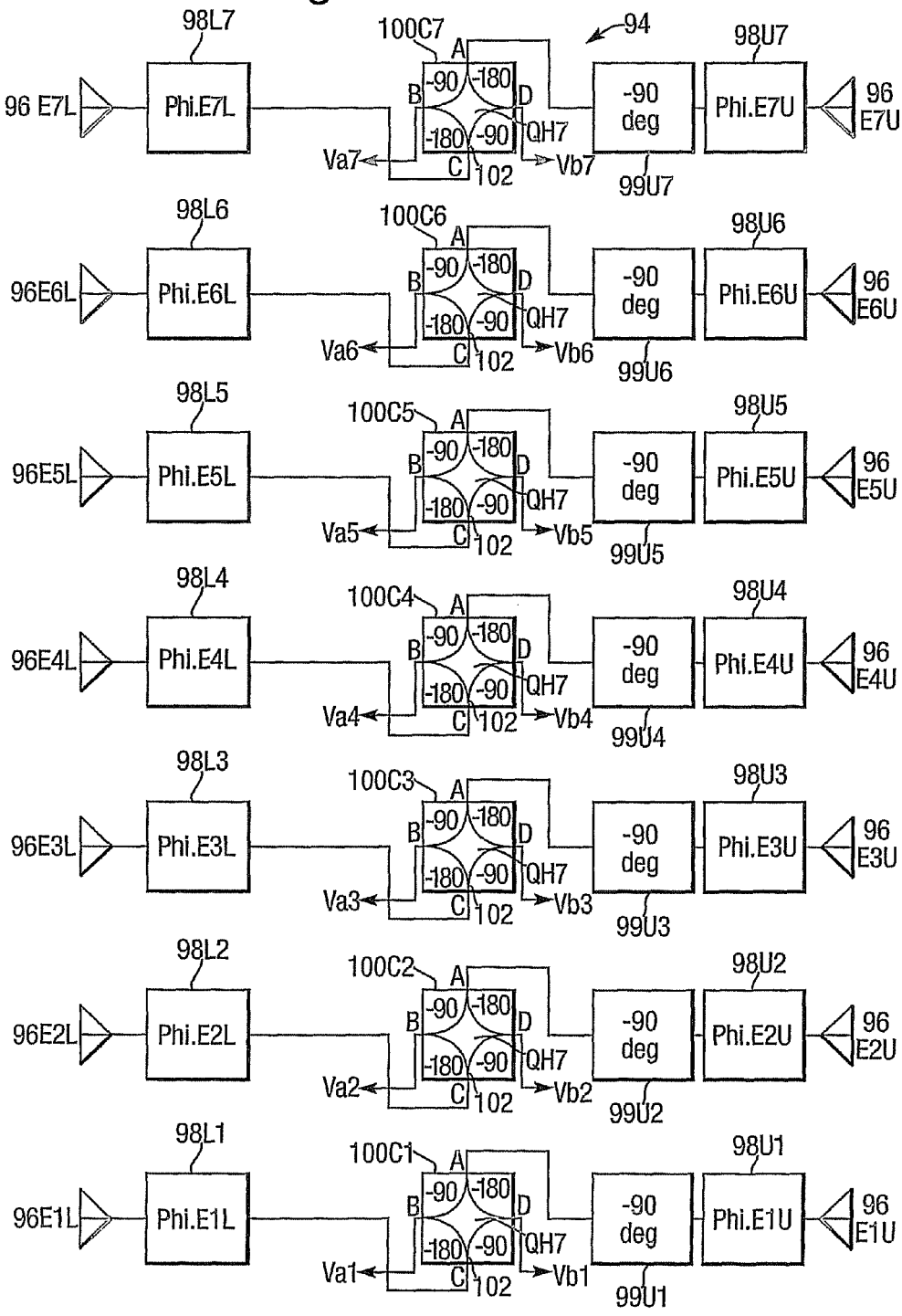
FIG. 8 is a block diagram of the remainder of the phased array antenna system of FIG. 7, and shows power to phase conversion, phase shifting and antenna elements.

Referring now also to FIG. 8, a phased array 94 is connected (not shown) to the circuit 80 and comprises fourteen antenna elements 96E1U to 96E7U and 96E1L to 96E7L shown in upper/lower pairs such as 96E1U and 96E1L. FIG. 8 shows the electrical connection scheme in an illustrationally convenient manner with pairs of elements back to back, but in practice the antenna elements 96E1U etc. are arranged in a straight line and all point in the same direction. The upper antenna elements 96E1U to 96E7U are connected via respective preset phase shifters 98U1 to 98U7 and fixed −90 degree phase shifters 99U1 to 99U7 to quadrature hybrid directional couplers 1001C to 100C7. The lower antenna elements 96E1L to 96E7L are connected via respective preset phase shifters 98L1 to 98L7 to the couplers 100C1 to 100C7 also, there being a respective coupler 100Ci for each upper/lower element pair 96EUi/96ELi (i=1, 2, . . . 7). The preset phase shifters 98L1 to 98L7 are optional: they give the antenna array 96 a prearranged boresight direction corresponding to zero electrical tilt and optimise suppression of side lobes over the tilt range.

Each coupler 100C1 etc. receives a respective pair of input signals from the splitters 88*a* and 88*b*, i.e. the ith coupler 100Ci receives input signals Vai and Vbi with i having values 1 to 7 as before. Each coupler 100C1 etc. is equivalent to the coupler 86 mentioned earlier, i.e. each has four terminals A to D with intervening input-output paths indicated by curved lines such as 102. Coupler 100C1 receives input of Va1 and Vb2 at B and D respectively and generates −90 degree and −180 degree phase shifted versions of each: output A receives Va1 phase shifted −90 degrees and Vb2 phase shifted −180 degrees, and output C receives Va1 phase shifted −180 degrees and Vb2 phase shifted −90 degrees. Output A is connected via −90 degree phase shifter 99U1 and preset phase shifter 98U1 to antenna element 96E1U, and output C is connected via preset phase shifter 98L1 to antenna element 96E1L. Similar arrangements apply to power feeds to other upper/lower antenna element pairs 96E2U/96EL2 to 96E7U/96E7L. The ith quadrature hybrid coupler 100Ci and the −90 degree phase shifter 99Ui in combination provide power-to-phase conversion shown at 56 in FIG. 3.

Figure 9:
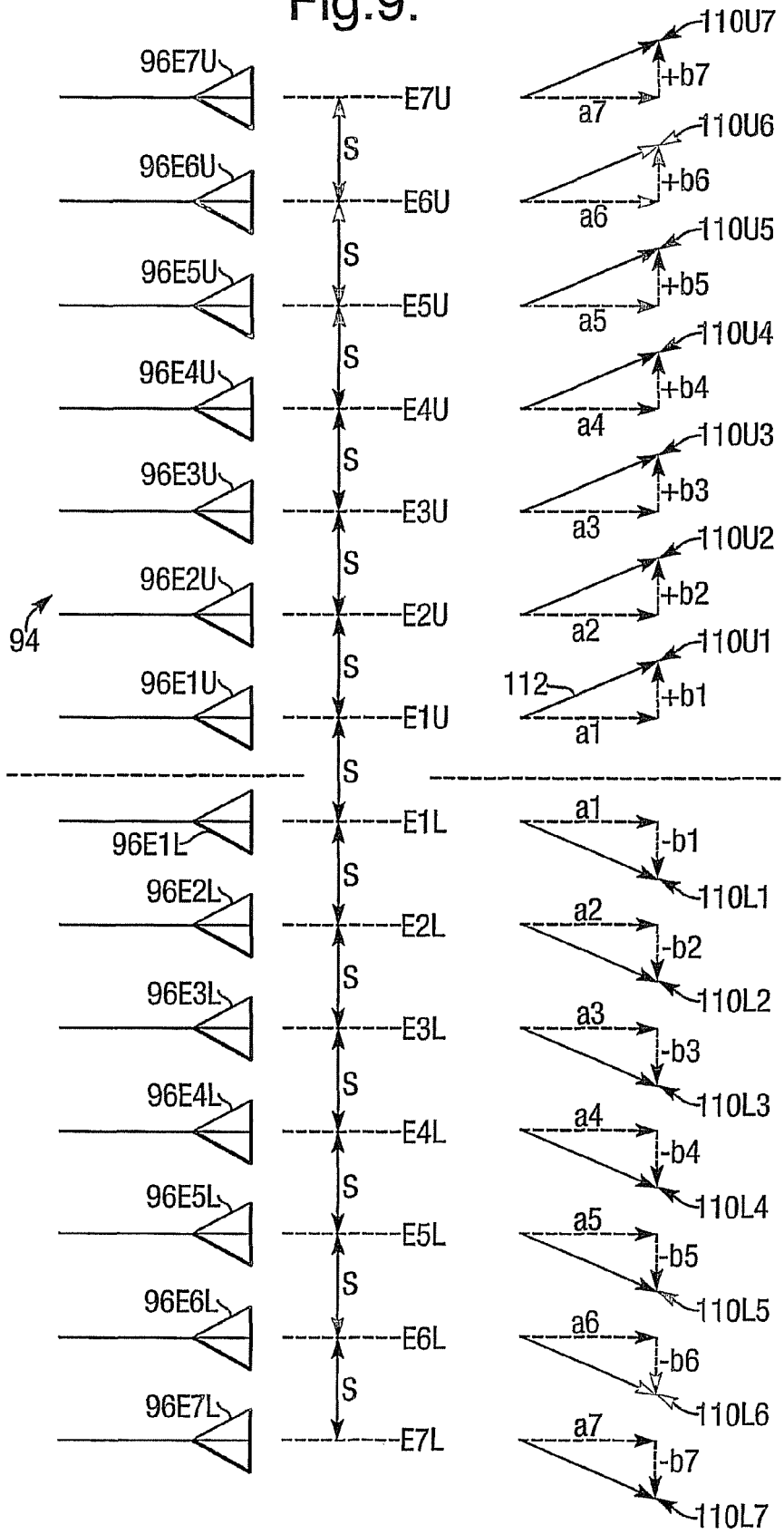
FIG. 9 illustrates location, spacing and drive signal phase of antenna elements in the FIG. 7 system.

Referring now also to FIG. 9, the phased array 96 is shown in its actual linear form, with each antenna element 96E1U etc. shown on the left hand side together with a respective vector diagram 110U1 to 110L7 to its right. Vector diagram 110U1 has a resultant arrow 112 arising from the vector addition of vectors a1 and b1, and representing the sum of the signals Va1 and Vb1 applied to antenna element 96E1U after various phase shifts as previously described. Similar remarks apply to other antenna elements. The ith upper antenna element 96EiU receives the vector sum ai+bi, and the ith lower antenna element 96EiL receives the vector difference ai−bi, The voltage and power ratios for the first splitter 88*a* in FIG. 7 are shown in Table 1 below. For convenience of representation the power levels are normalised so that the total power exiting from the splitter 88*a* is 1 watt. Voltages are square roots of powers so they are relative values also. The antenna element voltage levels have a raised cosine squared distribution. It is similar to curve 74 in FIG. 6, except strictly speaking curve 74 is binomial not cosine and curvatures differ.

TABLE 1

| Splitter 88a | Voltage | Power Ratio | |
|---|---|---|---|
| Output | Ratio | Power | Decibels |
| Va7 | 0.0010 | 0.000001 | −60.0 |
| Va6 | 0.0825 | 0.0068 | −21.7 |
| Va5 | 0.2014 | 0.0406 | −13.9 |
| Va4 | 0.3306 | 0.1093 | −9.6 |
| Va3 | 0.4494 | 0.2020 | −7.0 |
| Va2 | 0.5404 | 0.2920 | −5.4 |
| Va1 | 0.5911 | 0.3493 | −4.6 |

The voltage and power ratios for the second splitter 88*b* in FIG. 7 are shown in Table 2, expressed as relative values or ratios in the same way as those of Table 1.

TABLE 2

| Splitter 88b | Voltage | Power Ratio | |
|---|---|---|---|
| Output | Ratio | Power | Decibels |
| Vb7 | 0.2607 | 0.0680 | −11.7 |
| Vb6 | 0.4346 | 0.1889 | −7.2 |
| Vb5 | 0.5032 | 0.2532 | −6.0 |
| Vb4 | 0.4910 | 0.2411 | −6.2 |
| Vb3 | 0.4086 | 0.1670 | −7.8 |
| Vb2 | 0.2702 | 0.0730 | −11.4 |
| Vb1 | 0.0946 | 0.0090 | −20.5 |

Figure 10:
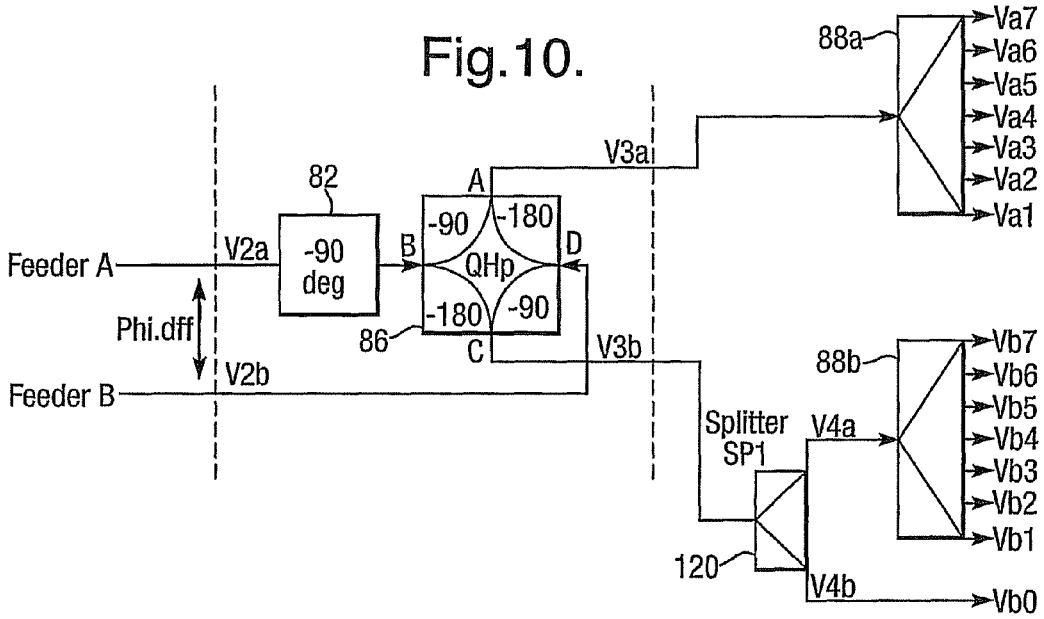
FIG. 10 is a block diagram of part of a still further phased array antenna system of the invention, and illustrates a dual feeder implementation using phase shifting, phase to power conversion and power division with generation of an additional signal for a central antenna element.
Figure 11:
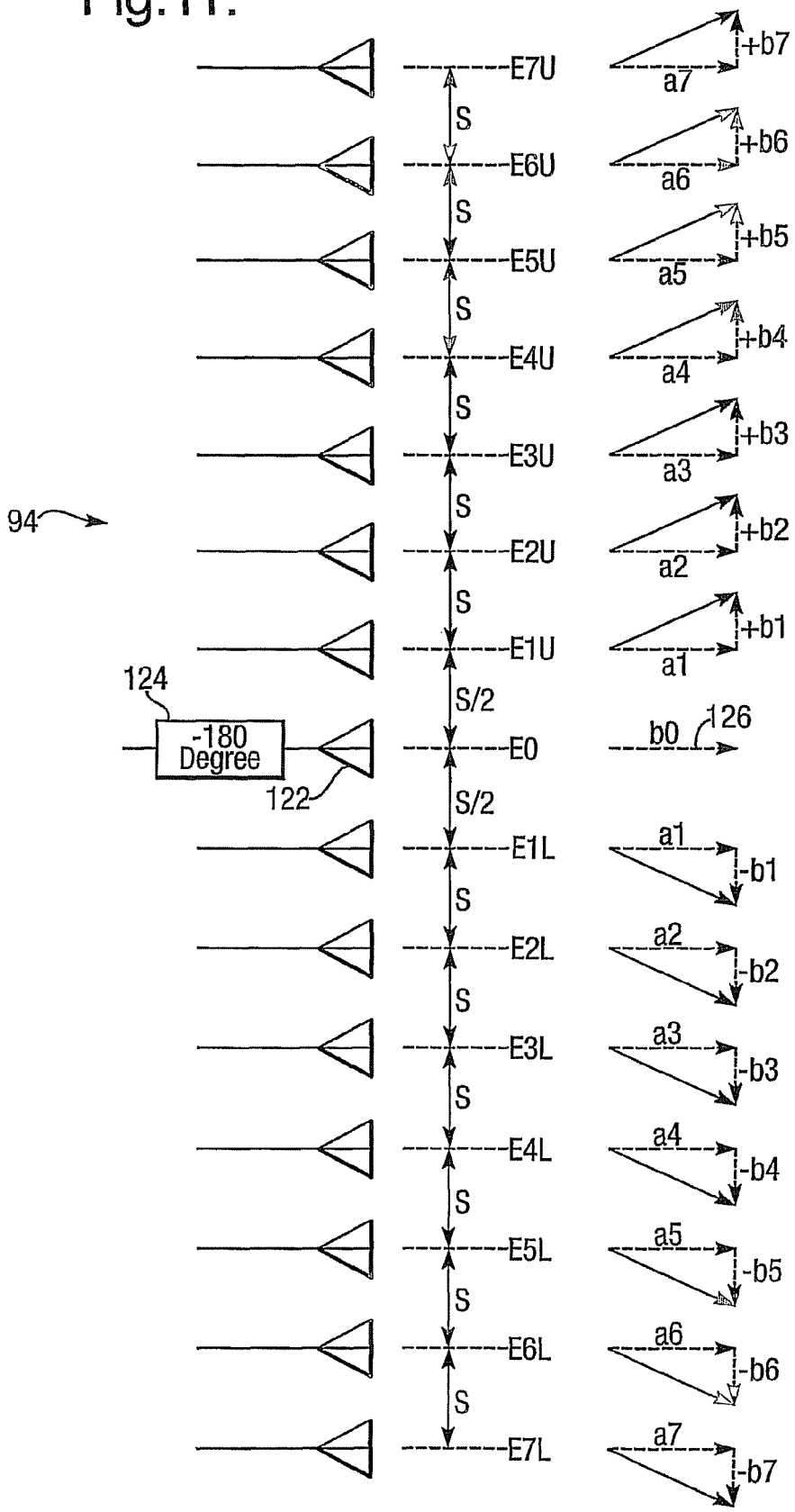
FIG. 11 illustrates the remainder of the phased array antenna system of FIG. 10, and shows an antenna array with a single central antenna element (element spacing is not to scale)

Referring now to FIGS. 10 and 11, there is shown a modification to the embodiment described with reference to FIGS. 7 to 9, and parts described earlier are like referenced. It is particularly suitable for a dual feeder implementation of the invention where it is preferable to reduce tilt sensitivity to reduce possible tilt error due to the effect of phase differences between signal feeders. There are two modifications: the first modification is to insert an extra splitter 120—a two way splitter—between output C of coupler 86 and the second splitter 88*b*. This allows some of the power hitherto fed to the second splitter 88*b* to be diverted to provide another signal Vb0. As shown in FIG. 11, the array 94 is modified by the introduction of an additional antenna element 122, which receives the Vb0 signal via a fixed 180 degree phase shifter 124. The additional antenna element 122 is located centrally of the array 94, which is otherwise unchanged; i.e. the element 122 is positioned a distance S/2 from each of antenna elements 96E1U and 96E1L, where S is the spacing between any other adjacent pair of antenna elements such as 96E1U and 96E2U. It is noted that for illustrational convenience the spacing between additional antenna element 122 is shown as equal to other spacings S but is labelled S/2.

FIG. 11 is equivalent to FIG. 9 with the addition of antenna element 122 and phase shifter 124: as indicated by vector diagram 126, this element 122 receives the signal Vb0 without subtraction of any vector signal from splitter 88*a*. The voltage and power ratios for splitter 88*b* are shown in Table 3 below. As before the power levels are normalised so that the total power exiting from splitter 88*b* is 1 watt. Equivalents for splitter 88*a* are as in Table 1 above.

TABLE 3

| Splitter | Voltage | Power Ratio | |
|---|---|---|---|
| Output | Ratio | Power | Decibels |
| Vb7 | 0.2355 | 0.0555 | −12.6 |
| Vb6 | 0.3925 | 0.1540 | −8.1 |
| Vb5 | 0.4544 | 0.2065 | −6.9 |
| Vb4 | 0.4434 | 0.1966 | −7.1 |
| Vb3 | 0.3690 | 0.1362 | −8.7 |
| Vb2 | 0.2440 | 0.0595 | −12.3 |
| Vb1 | 0.0855 | 0.0073 | −21.4 |
| Vb0 | 0.4294 | 0.1844 | −7.3 |

The direction of maximum gain of a phased array antenna is determined by the phase and amplitude of the voltages on its antenna elements. If the performance of the antenna is required to remain broadly the same over a band of frequencies then the phase and amplitude of the signals fed to the elements should remain the same as the frequency is changed. A length of transmission line has a delay which is constant and independent of frequency, and hence the phase shift it introduces in a signal passing along it increases with frequency. Consequently a phased array antenna which uses transmission lines as delay elements will have a performance that changes with frequency. A broadband directional coupler has the property that the phase relationships at its terminals remain constant over its working range of frequencies. Hence if directional couplers are used as delay elements in a phased array antenna, the antenna's performance will remain constant with frequency. It may also be advantageous, as a means of compensating for changes in side lobe level with the angle of electrical tilt, to retain the use of transmission lines as a delay element. Maximum design flexibility results if a combination of a transmission line and a directional coupler is used for delay/phase shift purposes.

Figure 12:
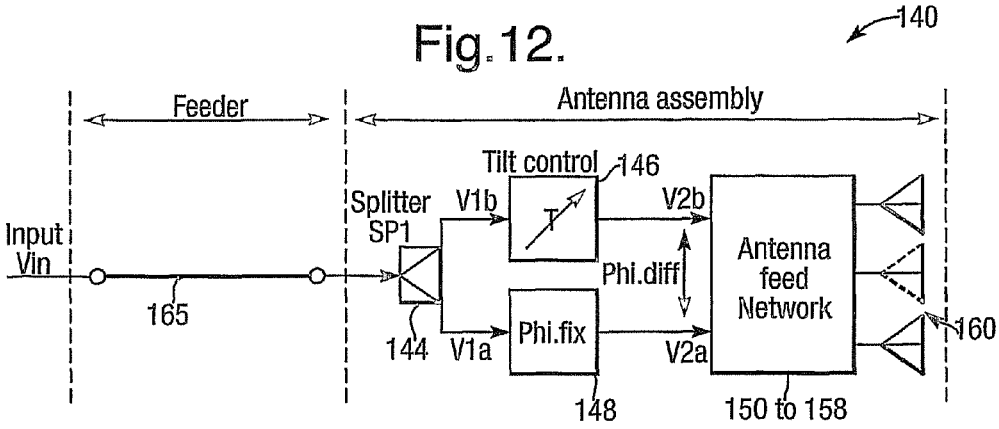
FIG. 12 illustrates use of the invention with a single feeder.

Referring now to FIG. 12, part of FIG. 3 has been reproduced and modified to illustrate single feed arrangements. Parts previously described are like-referenced with a prefix 100 and only changes will be described. A single signal feed 165 supplies an RF carrier signal to the splitter 144, which together with all components 146 to 160 inclusive are co-located. This requires adjustment of tilt at the antenna array 160, which may be on a mast.

Figure 13:
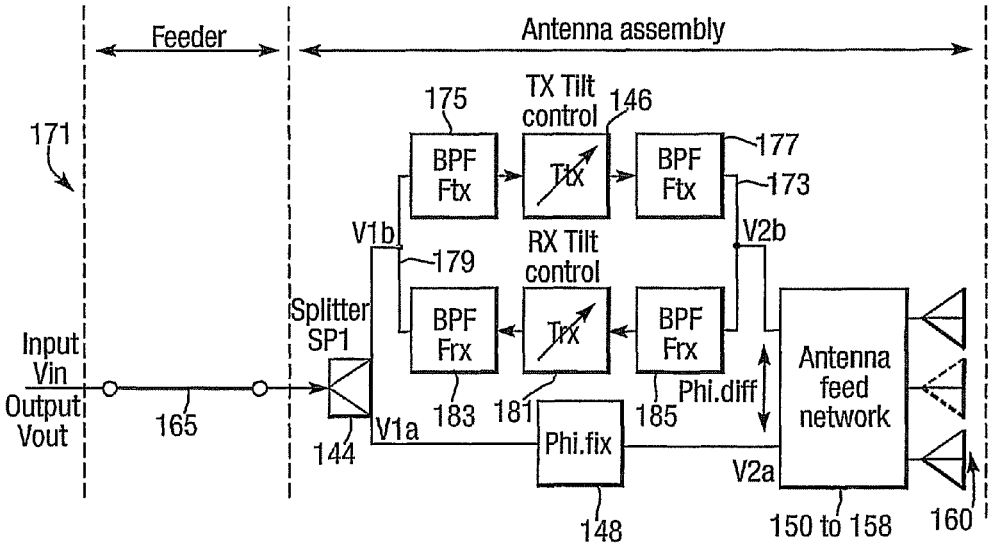
FIG. 13 shows a modification to the invention allowing angle of electrical tilt in transmit mode to be different to that in receive mode.

FIG. 13 shows a phased array antenna system 171 of the invention equivalent to that shown in FIG. 12 with modification for use in both receive and transmit modes. Parts previously described are like-referenced and only changes will be described. The variable phase shifter 146 with which tilt is controlled is now used in transmit (Tx) mode only, and is connected in a transmit path 173 between and in series with bandpass filters (BPF) 175 and 177. There is also a similar receive (Rx) path 179 with a variable phase shifter 181 between and in series with bandpass filters 183 and 185. Transmit and receive frequencies are normally sufficiently different to allow them to be isolated from one another by bandpass filters 175 etc. All elements 144 to 160 operate in reverse in receive mode with e.g. splitters becoming recombiners. The only difference been the two modes is that in transmit mode feeder 165 provides input and transmit path 173 is traversed by a transmit signal from left to right, whereas in receive mode receive path 179 is traversed by a receive signal from right to left and feeder 165 provides output. This arrangement is advantageous because it allows the angles of electrical tilt in both transmit and receive modes to be independently adjustable and to be made equal: normally (and disadvantageously) this is not possible because components have frequency dependent properties which differ between the transmit and receive frequencies.

Figure 14:
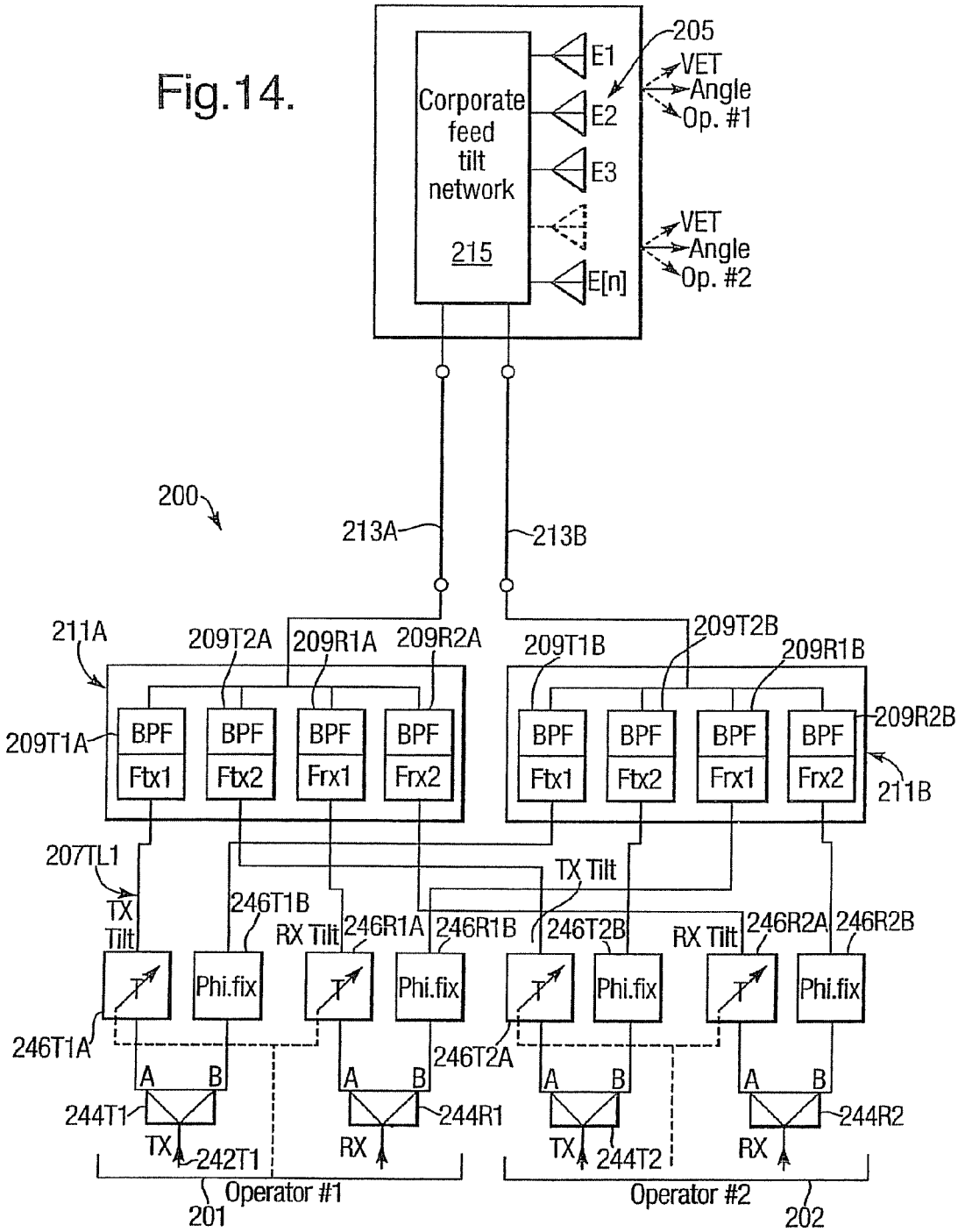
FIG. 14 is a block diagram of another phased array antenna system of the invention illustrating antenna sharing by multiple users with dual feeds and joint transmit/receive capability.

Referring now to FIG. 14, a phased array antenna system 200 of the invention is shown for use in transmit and receive modes by multiple (two) operators 201 and 202 of a single phased array antenna 205. Parts equivalent to those previously described are like referenced with a prefix 200. The drawing has a number of different channels: parts in different channels which are equivalent are numerically like-referenced with one or more suffixes: a suffix T or R indicates transmit or receive channel, a suffix 1 or 2 indicates first or second operator 201 or 202, and a suffix A or B indicates A or B path.

Initially a transmit channel 207T1 of the first operator 201 will be described. This transmit channel has an RF input 242 feeding a splitter 244T1, which divides the input between variable and fixed phase shifters 246T1A and 248T1B. Signals pass from the phase shifters 246T1A and 248T1B to bandpass filters (BPF) 209T1A and 209T1B in different duplexers 211A and 211B respectively. The bandpass filters 209T1A and 209T1B have pass band centres at a frequency of transmission of the first operator 201, this frequency being designated Ftx1 as indicated in the drawing. The first operator 201 also has a frequency of reception designated Frx1, and equivalents for the second operator 202 are Ftx2 and Frx2.

The first operator transmit signal at frequency Ftx1 output from the leftmost bandpass filter 209T1A is combined by the first duplexer 211A with a like-derived second operator transmit signal at frequency Ftx2 output from an adjacent bandpass filter 209T2A. These combined signals pass along a feeder 213A to an antenna tilt network 215 of the kind described in earlier examples, and thence to the phased array antenna 205. Similarly, the other first operator transmit signal at frequency Ftx1 output from bandpass filter 209T1B is combined by the second duplexer 211B with a like-derived second operator transmit signal at frequency Ftx2 output from an adjacent bandpass filter 209T2B. These combined signals pass along a second feeder 213B to the phased array antenna 205 via the antenna tilt network 215. Despite using the same phased array antenna 205, the two operators can alter their transmit angles of electrical tilt both independently and remotely from the antenna 205 merely by adjusting variable phase shifters 246T1A and 246T2A respectively.

Analogously, receive signals returning from the antenna 205 via network 215 and feeders 213A and 213B are divided by the duplexers 211A and 211B. These divided signals are then filtered to isolate individual frequencies Frx1 and Frx2 in bandpass filters 209R1A, 209R2A, 209R1B and 209R2B, which provide signals to variable and fixed phase shifters 246R1A, 246R2A, 248R1B and 248R2B respectively. Receive angles of electrical tilt are then adjustable by the operators 201 and 202 independently by adjusting their respectively variable phase shifters 246R1A and 246R2A.

The invention claimed is:

1. A phased array antenna system with variable electrical tilt and including an array of antenna elements, the system comprising:

a divider for dividing a radio frequency (RF) carrier signal into first and second signals, a variable phase shifter for introducing a variable relative phase shift between the first and second signals, a phase to power converter for converting the first and second signals having the variable relative phase shift into signals whose powers are a function of the variable relative phase shift, first and second power splitters for dividing the first and second signals that are converted into at least two sets of divided signals, and power to phase converters for combining pairs of divided signals from different power splitters to provide vector sum and difference components with appropriate phase for supply to respective pairs of antenna elements located at like distances with respect to an array centre.

2. The system according to claim 1 having an odd number of antenna elements comprising a central antenna element located centrally of each pair of like distant antenna elements.

3. The system according to claim 2 including a third power splitter connected between the phase to power converter and one of the first and second power splitters and arranged to divert to the central antenna element a proportion of power from the phase to power converter.

4. The system according to claim 1 wherein the phase to power converter and the power to phase converters are combinations of phase shifters and quadrature hybrid couplers.

5. The system according to claim 1 wherein the phase to power converter and the power to phase converters are combinations of phase shifters and 180 degree hybrid couplers.

6. The system according to claim 1 wherein the divider, the variable phase shifter, the phase to power converter, the power to phase converters and the first and second power splitters are co-located with the array of antenna elements as an antenna assembly and the antenna assembly has a single RF input power feed from a remote source.

7. The system according to claim 1 wherein the divider and the variable phase shifter are located remotely from the phase to power converter, the power to phase converters, the first and second power splitters and the array of antenna elements which are co-located as an antenna assembly, and the antenna assembly has dual RF input power feeds from a remote source.

8. The system according to claim 7 wherein the divider and the variable phase shifter are co-located with the remote source for use by an operator in varying angle of electrical tilt.

9. The system according to claim 7 including duplexers to combine signals passing from or divide signals passing to different operators which share the phased array antenna system.

10. The system according to claim 1 wherein the power splitters are arranged to provide for the antenna elements to receive drive voltages which fall from a maximum centrally of the array of antenna elements to a minimum at array ends.

11. The system according to claim 1 wherein one power splitter is arranged to provide a set of voltages which rise from a minimum to a maximum associated with the array centre and its ends respectively, as appropriate to establish a progressive phase front across the array of antenna elements, the phase front being substantially linear as an angle of tilt is increased in a working range of tilt, as required for reasonable boresight gain and side lobe suppression.

12. The system according to claim 1 wherein:

the variable phase shifter is a first variable phase shifter associated with a first filtering means defining a transmit path, the system includes a second variable phase shifter associated with a second filtering means defining a receive path, the system also includes elements operative in one direction in transmit mode and in a reverse direction in receive mode, and the system's angles of electrical tilt in transmit and receive modes are independently adjustable by means of the first and second variable phase shifters respectively.

13. A method of providing variable electrical tilt in a phased array antenna system including an array of antenna elements, the method comprising:

dividing a radio frequency carrier signal into first and second signals, introducing a variable relative phase shift between the first and second signals, converting the first and second signals having the variable relative phase shift into signals whose powers are a function of the variable relative phase shift, using power splitters to divide the first and second signals that are converted into at least two sets of divided signals, and combining pairs of divided signals from different power splitters to provide vector sum and difference components with appropriate phase for supply to respective pairs of antenna elements located at like distances with respect to an array centre and implementing such supply.

14. The method according to claim 13 wherein the array of antenna elements has an odd number of antenna elements comprising a central antenna element located centrally of each pair of like distant antenna elements.

15. The method according to claim 14 wherein the phased array antenna system includes a third power splitter connected to receive one of the signals whose power is a function of the variable relative phase shift and the method includes using such splitter to divert to the central antenna element a proportion of power in such signal.

16. The method according to claim 13 wherein conversion of the first and second signals having the variable relative phase shift and combining of pairs of divided signals are implemented respectively using phase to power and power to phase converters incorporating 90 or 180 degree hybrid couplers.

17. The method according to claim 13 wherein the dividing, the introducing, the converting, the using, and the combining are implemented using components co-located with the array of antenna elements to form an antenna assembly with input from a single RF input power feed from a remote source.

18. The method according to claim 13 wherein the dividing and the introducing are implemented using components located remotely of the array of antenna elements and the converting, the using, and the combining implemented using components co-located with the array of antenna elements and forming therewith an antenna assembly having dual RF input power feeds from a remote source.

19. The method according to claim 18 wherein the introducing includes varying the variable relative phase shift to vary an angle of electrical tilt.

20. The method according to claim 18 including combining signals passing from or dividing signals passing to different operators which share the phased array antenna system.

21. The method according to claim 13 including providing for the antenna elements to receive drive voltages which fall from a maximum centrally of the array of antenna elements to a minimum at array ends.

22. The method according to claim 13 wherein the using includes providing for one set of divided signals to rise from a minimum to a maximum associated with the array centre and its ends respectively, as appropriate to establish a progressive phase front across the array of antenna elements, the phase front being substantially linear as an angle of tilt is increased in a working range of tilt, as required for reasonable boresight gain and side lobe suppression.

23. The method according to claim 13 wherein:

the variable relative phase shift is a first variable phase shift introduced in a transmit path, the method includes introducing a second variable phase shift in a receive path, the phased array antenna system is operative in one direction in a transmit mode and in a reverse direction in a receive mode, and the method includes adjusting the phased array antenna system's angles of electrical tilt in the transmit and receive modes independently by adjusting the first and second variable phase shifts respectively.

* * * * *